US007971813B2

(12) United States Patent
O'Leary et al.

(10) Patent No.: US 7,971,813 B2
(45) Date of Patent: Jul. 5, 2011

(54) BLOWING MACHINE FOR LOOSEFILL INSULATION MATERIAL

(75) Inventors: Robert J. O'Leary, Newark, OH (US); Steven G. Schmitt, Newark, OH (US); Alvin L. Miller, Newark, OH (US); Willard Price, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1200 days.

(21) Appl. No.: 10/899,909

(22) Filed: Jul. 27, 2004

(65) Prior Publication Data

US 2006/0024458 A1 Feb. 2, 2006

(51) Int. Cl.
*B02C 23/20* (2006.01)

(52) U.S. Cl. ..... 241/60; 241/18; 241/225

(58) Field of Classification Search ..... 241/60, 241/101.78, 277, 605, 18; 239/379, 345
See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,235,542 | A | 3/1941 | Wenzel |
| 2,262,094 | A | 11/1941 | Burt |
| 2,273,962 | A | 2/1942 | Hubbard |
| 2,291,871 | A | 8/1942 | Bokum et al. |
| 2,308,197 | A | 1/1943 | Meyer |
| 2,355,358 | A | 8/1944 | Anderson |
| 2,404,678 | A | 7/1946 | Erb |
| 2,437,831 | A | 3/1948 | Moore |
| 2,532,318 | A | 12/1950 | Mackey et al. |
| 2,532,351 | A | 12/1950 | Wedebrock |
| 2,550,354 | A | 4/1951 | Jacobsen |
| 2,618,817 | A | 11/1952 | Slayter |
| 2,721,767 | A | 10/1955 | Kropp |
| 2,754,995 | A | 7/1956 | Switzer |
| 2,794,454 | A | 6/1957 | Moulthrop |
| 2,869,793 | A | 1/1959 | Montgomery |

(Continued)

FOREIGN PATENT DOCUMENTS

| | | |
|---|---|---|
| DE | 3238492 | 4/1984 |

(Continued)

OTHER PUBLICATIONS

Hearing Testimony, Case No. 09 CV 263 Division 2, Boulder County District Court, Colorado, Apr. 28, 2009, 11 pages.

(Continued)

*Primary Examiner* — Debra M Sullivan
(74) *Attorney, Agent, or Firm* — MacMillan, Sobanski & Todd, LLC

(57) ABSTRACT

A machine for distributing blowing wool from a bag of compressed blowing wool includes a chute configured to receive the bag, a shredder mounted at an outlet end of the chute and configured to shred the bag and to pick apart the blowing wool, a rotatably mounted ripper, distinct from the shredder, mounted to rip apart a portion of the bag, and a blower for distributing the blowing wool and shredded bag into an airstream.

22 Claims, 6 Drawing Sheets

U.S. PATENT DOCUMENTS

| | | | | |
|---|---|---|---|---|
| 2,938,651 | A | | 5/1960 | Specht et al. |
| 2,964,896 | A | | 12/1960 | Finocchiaro |
| 2,984,872 | A | | 5/1961 | France |
| 2,989,252 | A | | 6/1961 | Babb |
| 3,051,398 | A | * | 8/1962 | Babb ..... 241/136 |
| 3,061,206 | A | | 10/1962 | Matter |
| 3,175,866 | A | | 3/1965 | Nichol |
| 3,201,007 | A | | 8/1965 | Transeau |
| 3,231,105 | A | | 1/1966 | Easley |
| 3,278,013 | A | | 10/1966 | Banks |
| 3,314,732 | A | | 4/1967 | Hagan |
| 3,403,942 | A | | 10/1968 | Farnworth |
| 3,485,345 | A | | 12/1969 | Deasy |
| 3,556,355 | A | | 1/1971 | Ruiz |
| 3,591,444 | A | | 7/1971 | Hoppe at al. |
| 3,703,970 | A | | 11/1972 | Benson |
| 3,747,743 | A | | 7/1973 | Hoffmann, Jr. |
| 3,869,337 | A | | 3/1975 | Hoppe et al. |
| 3,895,745 | A | | 7/1975 | Hook |
| 3,952,757 | A | | 4/1976 | Huey |
| 3,995,775 | A | | 12/1976 | Birkmeier et al. |
| 4,059,205 | A | | 11/1977 | Heyl |
| 4,129,338 | A | | 12/1978 | Mudgett |
| 4,133,542 | A | | 1/1979 | Janian et al. |
| 4,134,508 | A | * | 1/1979 | Burdett, Jr. ..... 414/810 |
| 4,155,486 | A | | 5/1979 | Brown |
| 4,179,043 | A | | 12/1979 | Fischer |
| 4,180,188 | A | | 12/1979 | Anouma et al. |
| 4,236,654 | A | | 12/1980 | Mello |
| 4,268,205 | A | | 5/1981 | Vacca et al. |
| 4,273,296 | A | | 6/1981 | Hoshall |
| 4,337,902 | A | | 7/1982 | Markham |
| 4,344,580 | A | | 8/1982 | Hoshall et al. |
| 4,346,140 | A | | 8/1982 | Carlson et al. |
| 4,365,762 | A | | 12/1982 | Hoshall |
| 4,411,390 | A | | 10/1983 | Woten |
| 4,465,239 | A | | 8/1984 | Woten |
| 4,536,121 | A | | 8/1985 | Stewart et al. |
| 4,537,333 | A | | 8/1985 | Bjerregaard |
| 4,560,307 | A | | 12/1985 | Deitesfeld |
| 4,585,239 | A | | 4/1986 | Nicholson |
| 4,640,082 | A | | 2/1987 | Gill |
| 4,695,501 | A | | 9/1987 | Robinson |
| 4,716,712 | A | | 1/1988 | Gill |
| 4,784,298 | A | | 11/1988 | Heep et al. |
| 4,880,150 | A | | 11/1989 | Navin et al. |
| 4,915,265 | A | | 4/1990 | Heep et al. |
| 4,919,403 | A | | 4/1990 | Bartholomew |
| 4,978,252 | A | | 12/1990 | Sperber |
| 5,014,885 | A | | 5/1991 | Heep et al. |
| 5,037,014 | A | | 8/1991 | Bliss |
| 5,052,288 | A | | 10/1991 | Marquez et al. |
| 5,129,554 | A | | 7/1992 | Futamura |
| 5,156,499 | A | | 10/1992 | Miklich |
| 5,289,982 | A | | 3/1994 | Andersen |
| 5,303,672 | A | | 4/1994 | Morris |
| 5,323,819 | A | | 6/1994 | Shade |
| 5,380,094 | A | | 1/1995 | Schmidt et al. |
| 5,392,964 | A | | 2/1995 | Stapp et al. |
| 5,405,231 | A | | 4/1995 | Kronberg |
| 5,462,238 | A | * | 10/1995 | Smith et al. ..... 241/243 |
| 5,474,241 | A | * | 12/1995 | Kennedy ..... 241/81 |
| 5,511,730 | A | | 4/1996 | Miller et al. |
| 5,601,239 | A | * | 2/1997 | Smith et al. ..... 241/29 |
| 5,620,116 | A | | 4/1997 | Kluger et al. |
| 5,624,742 | A | | 4/1997 | Babbitt et al. |
| 5,639,033 | A | | 6/1997 | Miller et al. |
| 5,642,601 | A | | 7/1997 | Thompson, Jr. et al. |
| 5,647,696 | A | | 7/1997 | Sperber |
| 5,683,810 | A | | 11/1997 | Babbitt et al. |
| 5,819,991 | A | | 10/1998 | Khon et al. |
| 5,829,649 | A | | 11/1998 | Horton |
| 5,860,232 | A | | 1/1999 | Nathenson et al. |
| 5,860,606 | A | | 1/1999 | Tiedeman et al. |
| 5,927,558 | A | | 7/1999 | Bruce |
| 5,934,809 | A | | 8/1999 | Marbler |
| 5,987,833 | A | | 11/1999 | Heffelfinger et al. |
| 6,004,023 | A | | 12/1999 | Koyanagi et al. |
| 6,036,060 | A | | 3/2000 | Munsch et al. |
| 6,070,814 | A | | 6/2000 | Deitesfeld |
| 6,074,795 | A | | 6/2000 | Watanabe et al. |
| 6,161,784 | A | | 12/2000 | Horton |
| 6,209,724 | B1 | | 4/2001 | Miller |
| 6,266,843 | B1 | | 7/2001 | Donan et al. |
| 6,296,424 | B1 | | 10/2001 | Ecket et al. |
| 6,312,207 | B1 | | 11/2001 | Rautiainen |
| 6,503,026 | B1 | | 1/2003 | Mitchell |
| 6,510,945 | B1 | | 1/2003 | Allwein et al. |
| 6,698,458 | B1 | | 3/2004 | Sollars |
| 6,779,691 | B2 | | 8/2004 | Cheng |
| 6,783,154 | B2 | | 8/2004 | Persson et al. |
| 6,796,748 | B1 | | 9/2004 | Sperber |
| 6,826,991 | B1 | | 12/2004 | Ramussen |
| 7,284,715 | B2 | | 10/2007 | Dziesinski et al. |
| 7,354,466 | B2 | | 4/2008 | Dunning et al. |
| 2001/0036411 | A1 | | 11/2001 | Walker |
| 2003/0075629 | A1 | * | 4/2003 | Lucas et al. ..... 241/277 |
| 2003/0192589 | A1 | | 10/2003 | Jennings |
| 2003/0215165 | A1 | | 11/2003 | Hogan et al. |
| 2005/0006508 | A1 | | 1/2005 | Roberts |
| 2005/0242221 | A1 | * | 11/2005 | Rota ..... 241/236 |
| 2006/0024456 | A1 | | 2/2006 | O'Leary et al. |
| 2006/0024457 | A1 | | 2/2006 | O'Leary et al. |
| 2006/0024458 | A1 | | 2/2006 | O'Leary et al. |
| 2006/0231651 | A1 | | 10/2006 | Evans et al. |
| 2007/0138211 | A1 | | 6/2007 | O'Leary et al. |
| 2008/0087751 | A1 | | 4/2008 | Johnson et al. |

FOREIGN PATENT DOCUMENTS

| | | | |
|---|---|---|---|
| DE | 3240126 | | 5/1984 |
| EP | 0265751 | A1 * | 4/1988 |
| FR | 2350450 | | 3/1979 |
| GB | 1418882 | | 12/1975 |
| GB | 1574027 | | 9/1980 |
| GB | 2099776 | | 12/1982 |
| GB | 2124194 | | 2/1984 |
| GB | 2156303 | | 10/1985 |
| GB | 2212471 | | 7/1989 |
| GB | 2276147 | | 9/1994 |
| JP | 407088985 | | 4/1995 |
| NL | 8 204 888 | | 7/1984 |

OTHER PUBLICATIONS

Hearing Testimony, Case No. 09 CV 263 Division 2, Boulder County District Court, Colorado, Apr. 29, 2009, 14 pages.

Hearing Testimony, Case No. 09 CV 263 Division 2, Boulder County District Court, Colorado, Apr. 30, 2009, 35 pages.

Hearing Testimony, Case No. 09 CV 263, Boulder County District Court, Colorado, May 1, 2009, 18 pages.

Hearing Testimony, Case No. 09 CV 263 Division 2, Boulder County District Court, Colorado, May 4, 2009, 27 pages.

Hearing Testimony, Case No. 09 CV 263 Division 2, Boulder County District Court, Colorado, May 5, 2009, 5 pages.

Hearing Testimony, Case No. 09 CV 263 Division 2, Boulder County District Court, Colorado, May 7, 2009, 8 pages.

Hearing Testimony, Case No. 09 CV 263 Division K, Boulder County District Court, Colorado, May 7, 2009, 8 pages.

Blow-Matic 8, Abiff Manufacturing Corp., Denver, CO, www.fiberiffic.com, Copyright 2002-2004 Ark-Seal, LLC, CT0000550-CT0000552, 3 pages.

Krendl #425, Krendl Machining Company, Delphos, OH, www.krendlmachine.com, Copyright Jan. 2009, CT000357-CT000358, 2 pages.

Krendl #250A, Krendl Machining Company, Delphos, OH, www.krendlmachine.com, Copyright Apr. 2008, CT000359-CT000360, 2 pages.

Insulation Blowers—Accul 9118, Insulation Machine Corp., Springfield, MA, Copyright 2006, http://accuone.com/accul_9118.html-4/4/09, CT0000056-CT0000057, 2 pages.

AccuOne 9400, AccuOne Industries, Inc., Copyright 1998, http://www.accu1.com/A9400.html-7/13/04, CT0000059, 1 page.

Cocoon Insulation, Cocoon, Charlotte, NC, Copyright 2003 U.S. Green Fiber, LLC and Copright 2003 by Lowe's, CT0000071-CT0000076, 6 pages.

X-Floc Minifant M99, X-Floc GmbH, Renningen, Germany, Mar. 18, 2009, http://www.x-floc.com/en/machines/minifant-m99.html-4/6/09, CT0000449-CT0000451, 3 pages.
X-Floc Zellofant M95, X-Floc GmbH, Renningen, Germany, Feb. 8, 2009, http://www.x-floc.com/en/machines/zellofant-m95.html-4/13/09, CT0000107-CT0000112, 6 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
PCT Search Report for PCT/US05/26256 dated Nov. 22, 2005.
PCT Search Report for PCT/US05/27124 dated Nov. 22, 2005.
Nonaka-Yasuhiro, Japanese Trade-Journal, Article, Characteristics of Functional Chromium Plating and Its Application, , 1999.
Operator's Manual for Unisul's Mini-Matic Insulation Blowing Machine, Mfg. by UNISUL, Winter Haven, FL, Publication: RTL 100, Aug. 2003, CT0000310-CT0000322, 13 pages.
Attic Protector Blow-In Fiber Glass, Johns Manville International-Insulation Group RIG 1718, Denver, CO, www.jm.com., Aug. 2000, REV, CT0000122-CT0000124, 3 page.
The Force/3 Insulation Blower, Intec, Frederick, CO,www.inteccorp.com/Force3.htm, Apr. 14, 2009, OC002939-OX002925, 3 pages.
The Quantum insulation Blower, Intec, Frederick, CO,www.intec-corp.com/Quantum.htm, Apr. 14, 2009, OC002923-OC002931, 2 pages.
The Wasp Insulation Blower, Intec, Frederick, CO, www.inteccorp.com/Wasp.com, May 18, 2005, CT0000352-CT0000354, 3 pages.
The Force/1, Intec, Frederick, CO, , D200-0200-00, KL REV, Mar. 2004, CT000008-CT0000055, 50 pages.
Krendl #450A, Krendl Machining Company, Delphos, OH, hitp:///?PartNo=450A, Jul. 13, 2004, CT0000067-CT0000068, 2 pages.
Isoblow Mini, Isocell Vertriebs G.M.B.H., Neumarkt Am Wallersee, Austria, www.isocell.at/home-page/blowing-technology/isoblow-mini.html, Apr. 4, 2009, CT0000436-CT0000438, 3 pages.
Insul/Maxx 1000, Spray Insulation Components, Oklahoma City, OK, www.sprayinsulation.com/catalog.asp, Jan. 4, 2008, CT0000606-CT0000608, 3 pages.
APSCO-Pneumatic Conveying: Dilute Phase Systems, Dense Phase Systems . . . Nov. 1, 2005.
Choose a pneumatic conveying system . . . ; Powder Bulk Engineering; Steve Grant, CSC Publishing, Dec. 2004.

* cited by examiner

BLOWING MACHINE FOR LOOSEFILL INSULATION MATERIAL

TECHNICAL FIELD

This invention relates to loosefill insulation for insulating buildings. More particularly this invention relates to distributing loosefill insulation packaged in a bag.

BACKGROUND OF THE INVENTION

In the insulation of buildings, a frequently used insulation product is loosefill insulation. In contrast to the unitary or monolithic structure in insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing wool, is typically compressed and packaged in bags for transport from an insulation manufacturing site to a building that is to be insulated. Typically the bags are made of polypropylene or other suitable material. During the packaging of the blowing wool, it is placed under compression for storage and transportation efficiencies. Typically, the blowing wool is packages with a compression ratio of at least about 5:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the bag is opened and the blowing wool is allowed to expand.

It would be advantageous if blowing wool machines could be improved to make them easier to use and transport.

SUMMARY OF THE INVENTION

The above objects as well as other objects not specifically enumerated are achieved by a machine for distributing blowing wool from a bag of compressed blowing wool. The machine includes a chute configured to receive the bag, a shredder mounted at an outlet end of the chute and configured to shred the bag and to pick apart the blowing wool, a rotatably mounted ripper, distinct from the shredder, mounted to rip apart a portion of the bag, and a blower for distributing the blowing wool and shredded bag into an airstream.

According to this invention there is also provided a machine for distributing blowing wool from a bag of compressed blowing wool, the machine including a ripper configured to rip apart a portion of the bag. The ripper comprises a rotatably mounted roller having a plurality of cutting teeth positioned along the length of the roller, and a framework intersecting the roller at a first location, the framework having a cutting edge complimentary to the cutting teeth on the roller so that portions of the bag enmeshed between the cutting teeth of the roller and the cutting edge of the framework will be ripped apart.

According to this invention there is also provided a method of distributing blowing wool from a bag of compressed blowing wool. The method includes providing a bag of compressed blowing wool, feeding the bag of compressed blowing wool into a chute configured to receive the bag, shredding the bag and picking apart the compressed blowing wool at an outlet end of the chute, and distributing the blowing wool and shredded bag into an airstream.

According to this invention there is also provided a method of distributing blowing wool from a bag of compressed blowing wool. The method includes providing a bag of compressed blowing wool, removing an end of the bag, shredding the remainder of the bag and picking apart the compressed blowing wool, and distributing the blowing wool and shredded bag into an airstream.

According to this invention there is also provided a bag of compressed blowing wool, with the bag having an end configured as a tear-away portion enabling the end of the bag to be readily torn away from the bag.

According to this invention there is also provided a bag of compressed blowing wool, including a body of blowing wool encapsulated in a sleeve and having at least one open end.

According to this invention there is also provided a machine for distributing blowing wool from a bag of compressed blowing wool. The machine includes a chute configured to receive the bag, a shredder mounted at an outlet end of the chute and configured to shred the bag and to pick apart the blowing wool, a mechanism for disposal of a portion of the bag, and a blower for distributing the blowing wool and shredded bag into an airstream.

Various objects and advantages of this invention will become apparent to those skilled in the art from the following detailed description of the preferred embodiment, when read in light of the accompanying drawings.

DETAILED DESCRIPTION OF THE INVENTION

Figure 2:
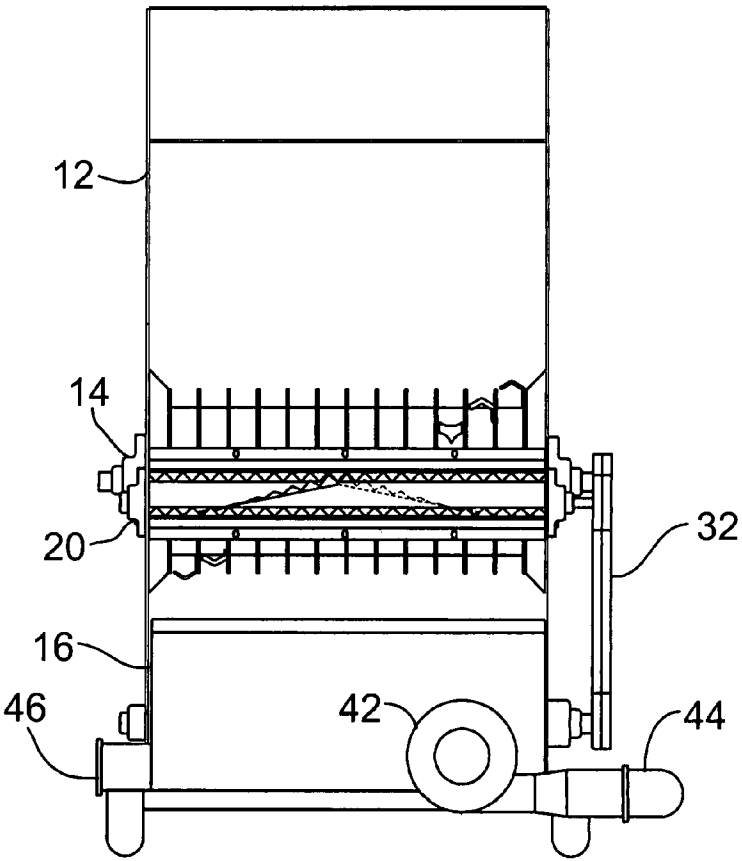
FIG. 2 is a front view in elevation of the insulation blowing wool machine of FIG. 1.
Figure 1:
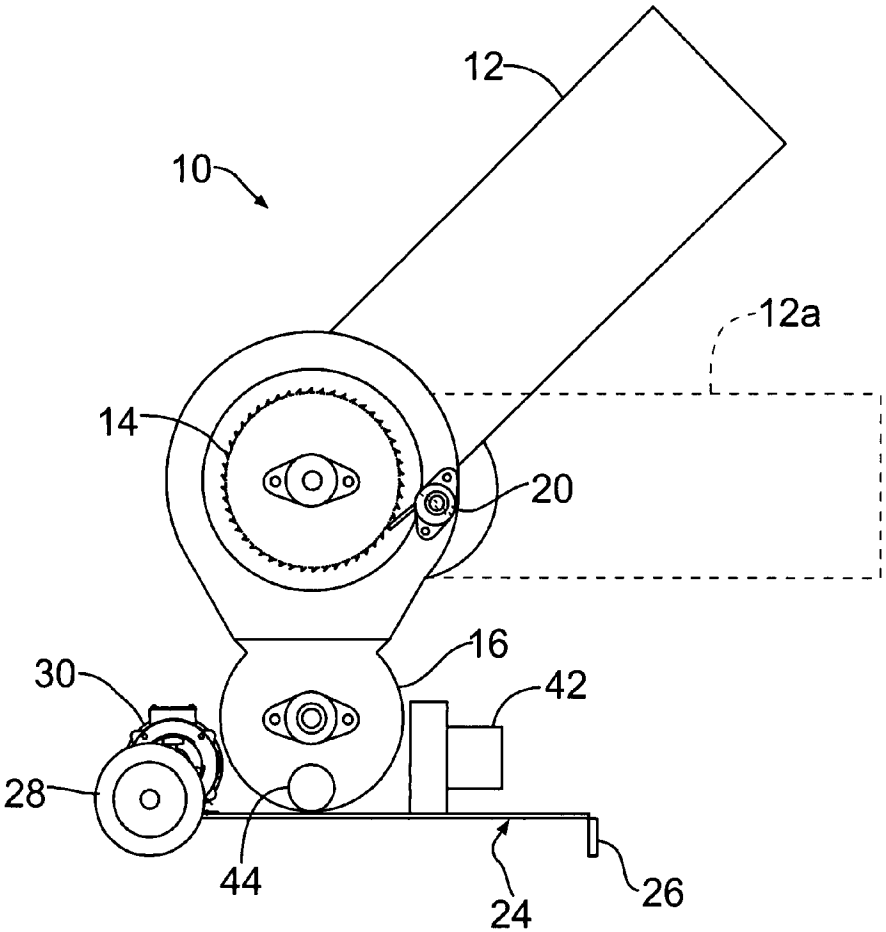
FIG. 1 is a side view in elevation of an insulation blowing wool machine.
Figure 3:
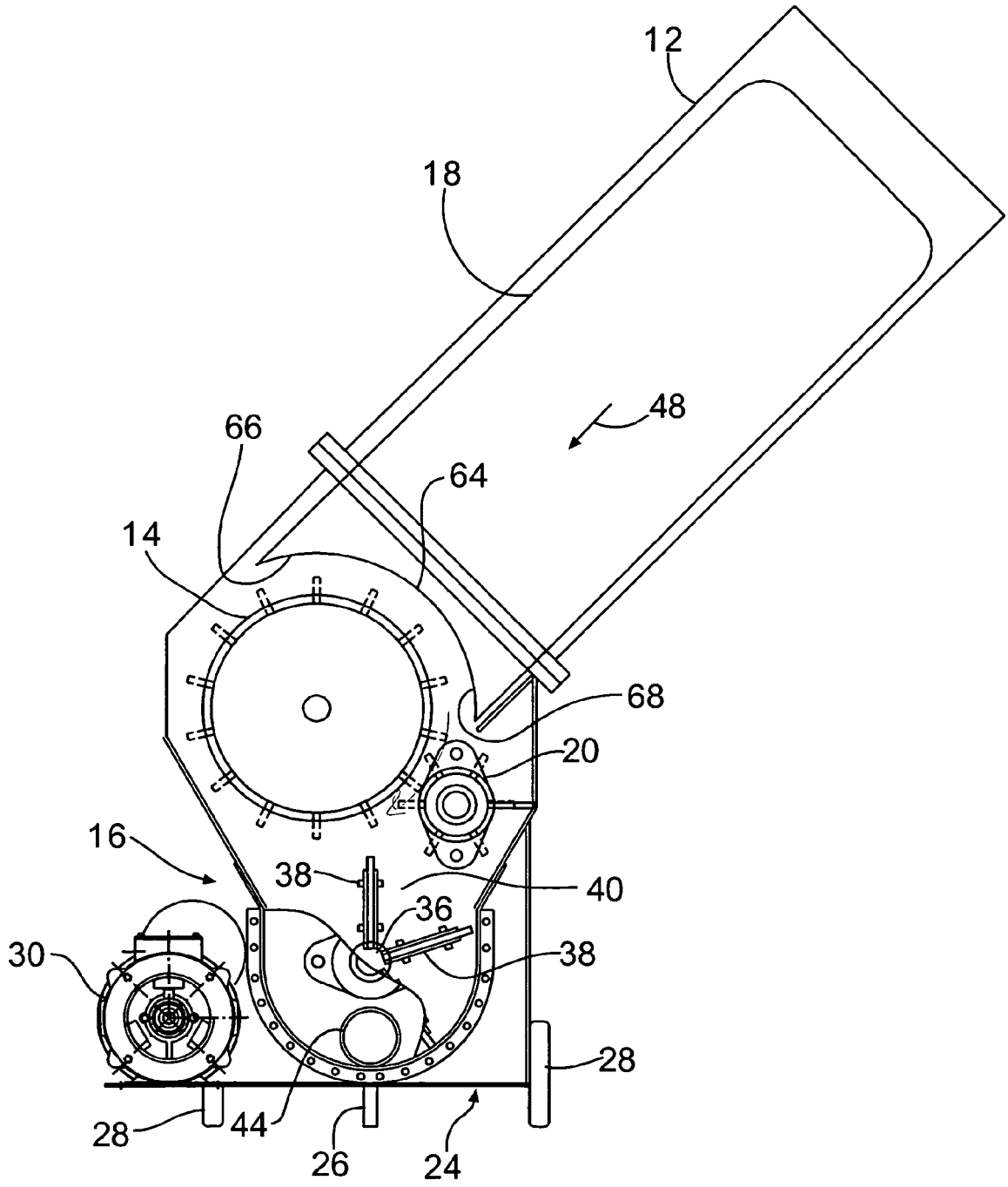
FIG. 3 is a partially cutaway elevational view of the machine of FIG. 1.
Figure 6:
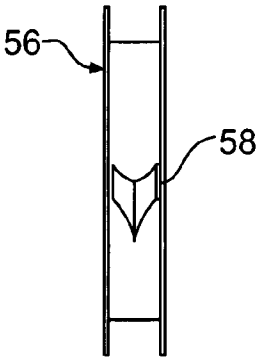
FIG. 6 is a side view of the spacer of FIG. 5, taken along line 6-6.
Figure 7:
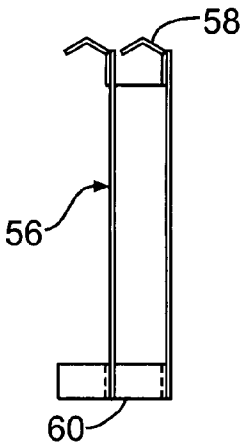
FIG. 7 is a side view of the spacer of FIG. 5, taken along line 7-7.

As shown in FIGS. 1-3, the blowing wool machine is indicated at 10. The machine 10 includes a chute 12 configured to receive a bag of insulation material, and a shredder 14 for shredding the bag of insulation and picking apart the blowing wool. A rotary valve 16 is also included in the blowing wool machine 10 for distributing the blowing wool. As shown in FIG. 3, a bag of compressed blowing wool 18 is placed in the chute 12 to introduce the blowing wool to the shredder 14. In general, the shredder 14 shreds the bag 18 of blowing wool and the blowing wool is distributed by means of the rotary valve 16. Also included in the blowing wool machine 10 is a ripper 20 for ripping apart a portion of the material of the bag 18 as the shredder 14 engages the bag 18 at the outlet end of the chute 12. Optionally, the machine is mounted on a frame 24, which includes a handle 26 and wheels 28. This makes the machine relatively easy to move from one location to another. Also, optionally the chute can be mounted for a rotation to a retracted position as shown at 12*a* for ease of storage and transportation. The shredder 14, ripper 20, and rotary valve 16 are all mounted for rotation. They can be rotatably driven by suitable means, such as by an electric motor 30 and belts and pulleys 32. Alternatively, each of the shredder 14, ripper 20, and rotary valve 16 can be provided with its own electric motor.

The shredder 14 shreds the bag 18 and picks apart the blowing wool, and the shredded bag pieces and the blowing wool drop from the shredder 14 into the rotary valve 16. As shown in FIG. 3 the rotary valve includes a central hub 36 and a plurality of vanes 38 arranged radially. The vanes form compartments 40 which collect the bag pieces and blowing wool. When the rotary valve 16 rotates to the lowest position the compartment 40, the bag pieces and blowing wool will be entrained by the flowing stream of air from the blower 42, which is shown in FIG. 2. The blower 42 draws air from the inlet 44 and through the lowermost compartment 40 of the rotary valve 16, and then through the outlet 46 to distribute the blowing wool and shredded bag pieces. Attached to the outlet 46 is a distribution hose, not shown, for directing the airstream of blowing wool and shredded bag parts toward the insulation cavity.

The blowing wool in bag 18 can be any loosefill insulation, such as a multiplicity of discrete, individual tuffs, cubes, flakes, or nodules. The blowing wool can be made of glass fibers or other mineral fibers, and can also be organic fibers or cellulose fibers. The blowing wool in the bag 18 is compressed to a compression ratio of at least 5:1, which means that the unconstrained blowing wool after the bag is removed has a volume of 5 times that of the blowing wool in the bag. Typically, the compression ratio is about 20:1 or higher. The bag itself is typically made of a polymeric material, such as polyethylene, although any type of material suitable for maintaining the blowing wool in the desired compression can be used. Preferably, the bag will provide a waterproof barrier against water, dirt and other deleterious effects. By using a polymeric material for the bag, the blowing wool will be protected from the elements during transportation and storage of the bag. The preferred bag material is sufficiently robust to handle the physical abuse to which these bags are frequently subjected.

Typical bags of compressed blowing wool have rounded generally rectangular cross-sectional shapes. For example, the bag might have a height of about 8 inches, a width of about 19 inches and a length of about 38 inches. Such a bag might have a weight of about 35 pounds. Optimally, the chute 12 has a cross sectional shape which approximates the cross section of the bag 18. For example, for the bag specified above, the chute 12 might have a cross-section of about 9 inches by 20 inches. This allows the bag to be easily received and fed through the chute 12 in the machine direction 48 to be engaged by the shredder 14. By providing the chute with a cross section that approximates the cross section of the bag 18, the bag 18 will be contained and prevented from expanding prior to the point at which the bag is engaged by the shredder 14. The bag 18 can be moved through the chute 14 by the force of gravity if the chute is in a raised or upright position, as shown in FIG. 1. Alternatively, a ram or pusher, not shown, can be used to move the bag 18 along the chute 12. Where a ram is used, the chute 14 does not have to be in a vertical position, as shown in FIG. 1, but rather can be in any suitable orientation.

Figure 5:
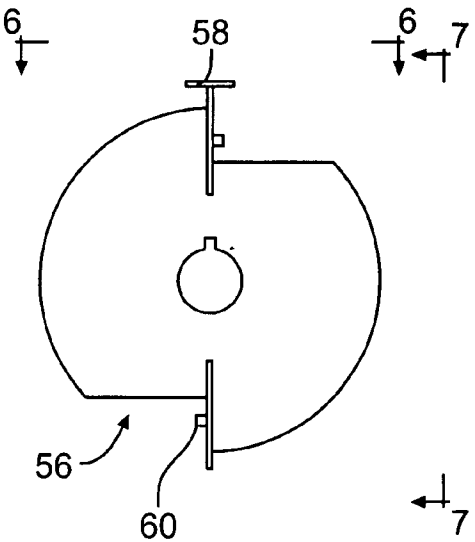
FIG. 5 is a side view of the spacer of FIG. 4.
Figure 4:
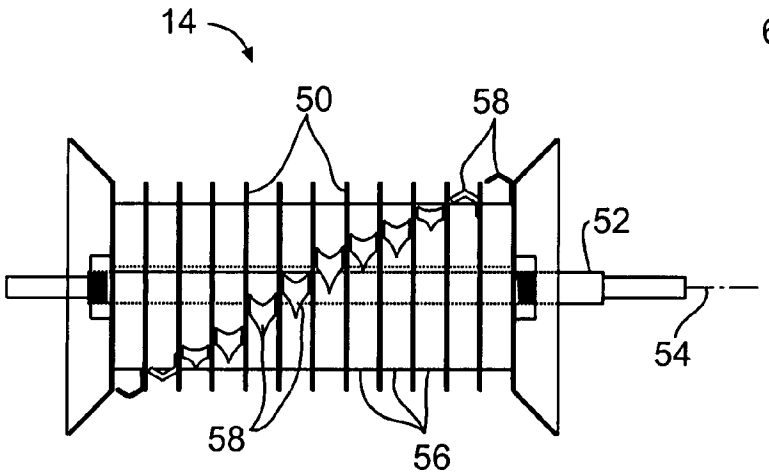
FIG. 4 is an elevational view of the shredder of the blowing wool machine of FIG. 1.

As shown in FIGS. 4-7, the shredder 14 includes a plurality spaced apart blades 50, mounted for rotation on a shredder shaft 52, which is aligned along the shredder axis 54. The spaced apart blades 50 are generally parallel to the machine direction 48. Typically the shredder blades 50 are mounted on centers of 1.25 inches although other spacings can be used. The blades 50 are spaced apart by spacers 56. The spacers 56 are generally disc shaped as shown in FIG. 5. Preferably the blades 50 and the spacers 56 are keyed to fix them to the shredder shaft 52. When viewing FIG. 4, it can be seen that the blades 50 extend outwardly from the shredder 14. When the bag of compressed blowing wool 18 engages the shredder 14, the rotating blades 50 define cuts or slits in the blowing wool.

Mounted on the spacer 56 is a mechanism which picks apart the blowing wool between the cuts made by the blades 50. The mechanism can be any suitable member for picking apart or loosening the highly compressed blowing wool between the cuts formed by the blades 50. In a preferred embodiment of the invention the mechanism is a plow shaped member, or plow 58 having a central ridge and outwardly extending flanges. Preferably the plow 58 is mounted on the spacer 56 in a cantilevered manner, although other mounting configurations can be used. The leading edge of the plow 58, being pointed, enables the plow 58 to dig into the blowing wool between the cuts made by the spacer 56. It can be seen from FIG. 4 that each spacer 56 is provided with one plow 58, and that the plows are staggered circumferentially about the shredder shaft 52 so that only one of the plows 58 engages the blowing wool at a time. Although the spacer 56 is shown with one plow 58, the spacer 56 can function with more than one plow 58. Also the plows of adjacent spacers need not be staggered circumferentially. With the plow 58 rotating clockwise, as shown in FIG. 3, the leading edge of the plow is oriented tangentially to the outer perimeter of the shredder, in the direction of rotation.

Figure 13:
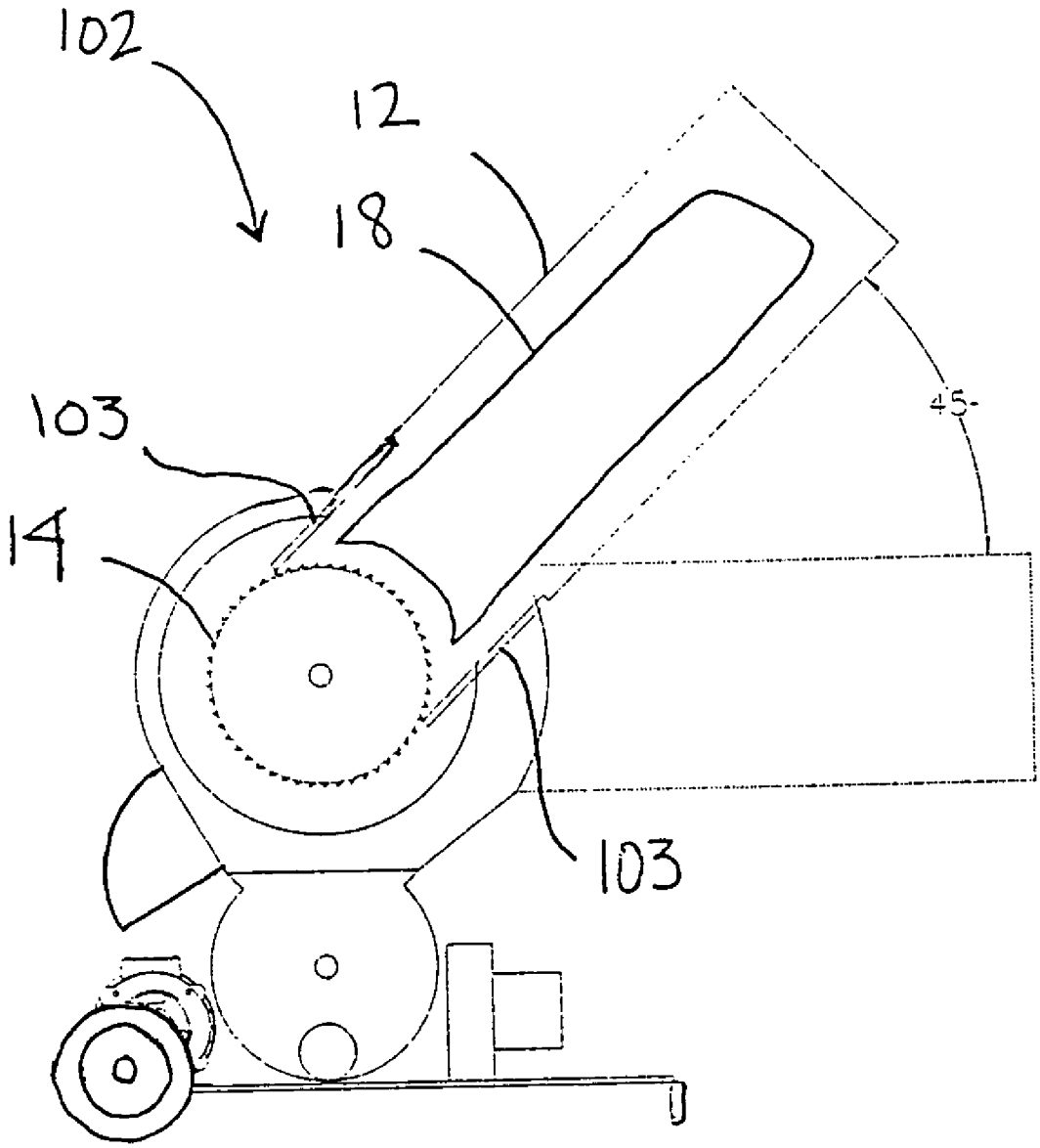
FIG. 13 is a side view in elevation of an alternative embodiment of the insulation blowing wool machine.

The shredder 14 typically turns in a clockwise direction as opposed to the ripper 20 which rotates in a counter clockwise direction. In an alternative embodiment as shown in FIG. 13, the blowing wool machine 102 contains a shredder 14 may rotate in a clockwise direction for a period of time and then turn in the counter-clockwise direction, i.e., continuously alternating in clockwise/counter-clockwise directions. Semi-rigid guides 103 hold the bag 18 in place while the shredder 14 rotates and shreds the bag. The guides 103 also hold the unconstrained blowing wool together when the trailing edge 68 of the bag 18 has been reached. In this embodiment, the ripper 20 is not required as the alternating clockwise and counter-clockwise directions of the shredder 14 permit the bag 18, and the blowing wool, to be effectively shredded and dropped from the shredder 14 into the rotary valve 16

Turning again to FIGS. 4-7, positioned on each of the spacers 56 is a mechanism, such as scoop 60, for removing the blowing wool insulation material ripped apart or loosened by the plow 58. The scoop 60 is generally diametrically opposed from the plow 58 on the spacer 56, as shown in FIG. 5. The scoop 60 can be any member, including a flange, a fork, or a web, suitable for removing the blowing wool insulation material ripped apart or loosened by the plow 58. Although not shown, more than one scoop 60 could be attached on each spacer 56.

Figure 10:
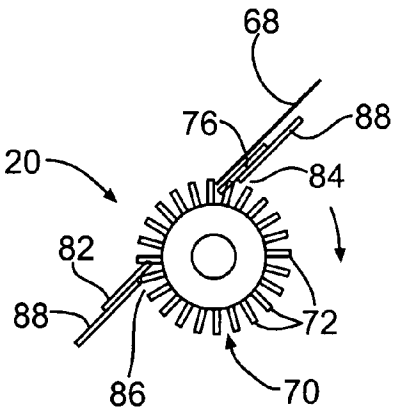
FIG. 10 is a side view of the ripper of FIG. 8.
Figure 8:
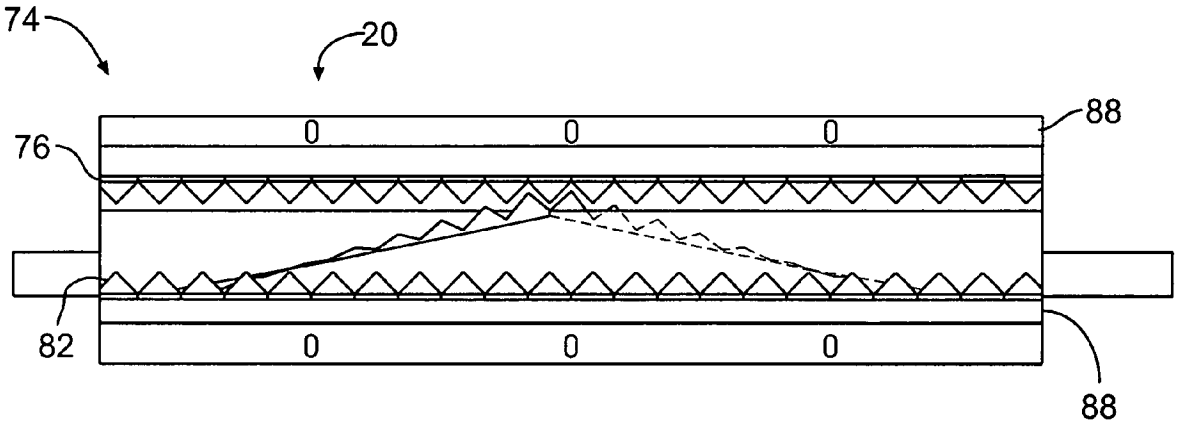
FIG. 8 is an elevational view of the ripper of the blowing wool machine of FIG. 3.
Figure 9:
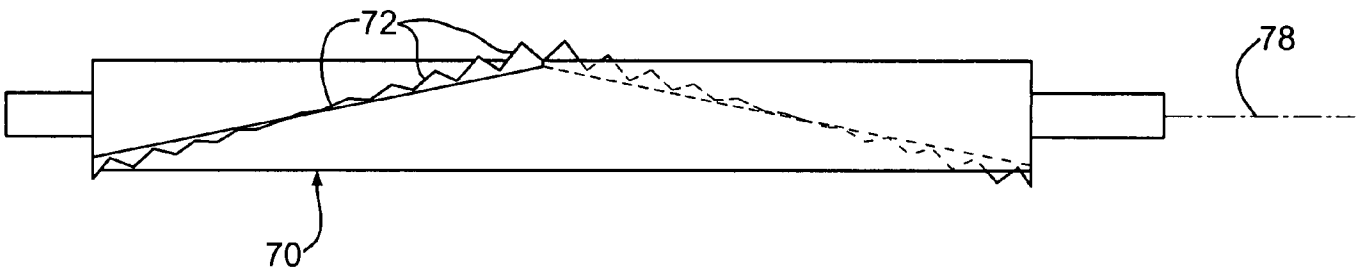
FIG. 9 is an elevational view of the ripper roller of FIG. 8.

As the bag 18 is being fed downwardly to engage the shredder 14, the shredder consumes the lower most surface 64 of bag and the blowing wool contained in the bag 18, as shown in FIG. 3. The lower most surface 64 is formed in a curved shape because of the action of the curved shredder 14. The plows 58 on the spacers 56 easily shred the bag 18 and pick apart the highly compressed blowing wool, particularly at the leading edge 66 of the bag and along most of the lower most surface 64. The leading edge 66 is the portion of the lowermost surface 64 that is first encountered by the rotating blades 50. However because of the orientation of the plow 58, the trailing edge 68 of the bag 18 is not readily shredded. In order to shred all parts of the bag 18, the ripper 20, distinct from the shredder 14, is provided to assure that the trailing edge portion 68 of the bag 18 is ripped apart. As shown in FIGS. 8-10, the ripper 20 is comprised of rotatably mounted roller 70 having a plurality of teeth 72 positioned along the length of the roller 70.

The ripper 20 also includes an anvil framework 74 intersecting the roller 70. The framework 74 has a cutting edge 76 which has a shape complimentary to the cutting teeth 72 on the roller 70 so that portions of the bag enmeshed between the cutting teeth 72 of the roller 70 and the cutting edge 76 of the framework 74 will be ripped apart. Preferably the cutting edge 76 includes substantially triangular gaps, and the teeth 72 are substantially triangular in shape for a close tolerance, in a manner similar to that of pinking shears. It is to be understood that other shapes for the teeth 72 and the cutting edge 76 can be used. Although the teeth 72 can be aligned along a line parallel to the roller axis 78, it is preferred that the teeth 72 be spaced apart circumferentially about the roller to avoid an uneven impact during the ripping operation. In such a case, each of the teeth 72 will have a different angular or radial orientation from all the other teeth. This is shown in FIG. 10. Preferably, the teeth 72 are arranged on the roller 70 so that the teeth 72 are mounted along a single spiral line along the length of the roller 72. The teeth 72 can be fastened to the roller 70 in any suitable manner, such as by bolting the teeth 72 on the roller 70 with brackets, not shown. In a preferred embodiment of the invention, the teeth 72 are made of steel, and each tooth has a length along the roller axis 78 of approximately 1.25 inches, and has a thickness of approximately 0.125 inches. As shown in FIGS. 8 and 10, the ripper 20 can include a second cutting edge 82. The purpose of the second cutting edge 82 is to assure that ripped apart bag portions are removed from the roller 70 don't wrap around the roller. Other mechanisms could be used to clean the teeth 72.

Preferably, the roller 70 intersects the cutting edge 76 at a first location 84 and intersects the section cutting edge 82 at a second location 86, spaced apart circumferentially from the first location 84, as shown in FIG. 10. In a preferred embodiment of the invention, the cutting edge 76 and the second cutting edge 82 are mounted to the machine 10 by means of brackets 88. Any other means of attachment can be used.

Figure 11:
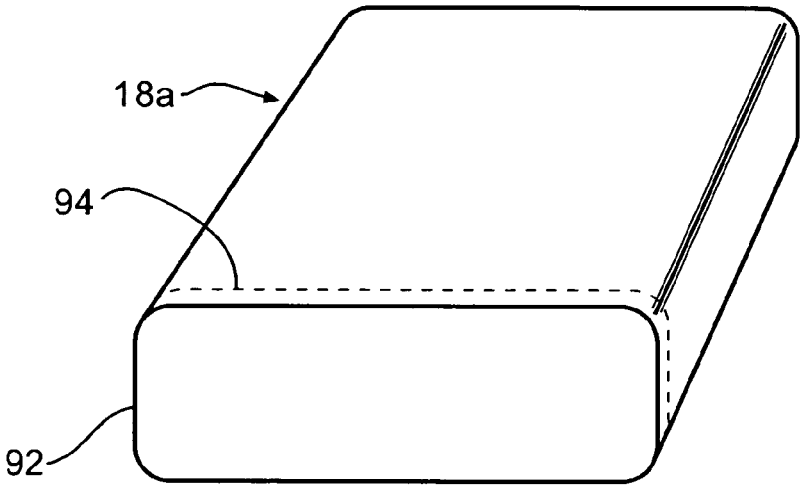
FIG. 11 is a perspective view of a bag of blowing wool having a tear-away end.

In order to facilitate the shredding of the bag as it moves in the machine direction 48 in the chute 12, it is desirable to remove the end 92 of the bag 18*a*. For this purpose, in one embodiment of the invention, the bag, indicated in FIG. 11 at 18*a*, is provided with a tear-away mechanism 94. The tear-away mechanism can be a line of serrations or weakened bag material, or can be a ripcord, not shown. Other tear-away mechanisms can also be used. In practice, the operator of the blowing wool distributing wool machine 10 tears away the tear-away portion or end 92 of the bag 18*a* and places the bag into the chute 12. The tear-away end of the bag 92 can be provided at either end or both ends of the bag 18*a*.

Figure 12:
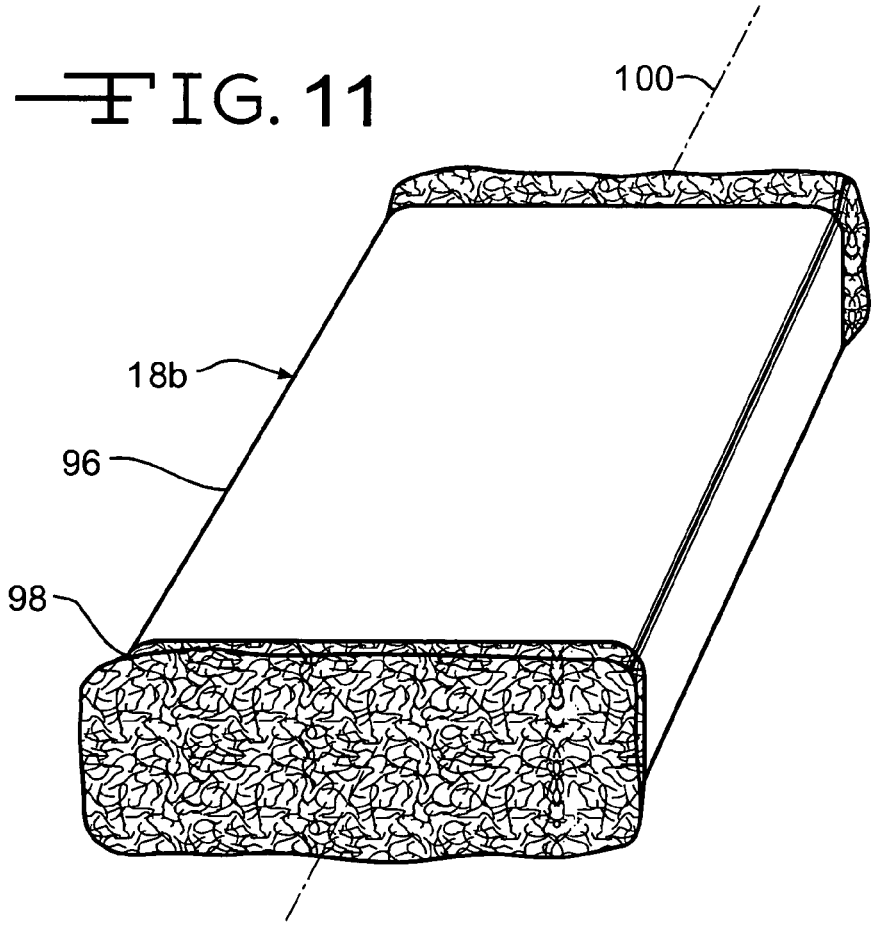
FIG. 12 is a perspective view of a different bag of blowing wool, packaged in a sleeve.

As shown in FIG. 12, in another embodiment of the invention, the bag of blowing wool, indicated at 18*b*, can be in form of a sleeve 96 which contains or encapsulates the body of blowing wool material 98. Preferably both of the ends are open, thereby eliminating the need for end bag material to be shredded by the shredder 14 and the ripper 20. Since the blowing wool 98 in typical bags of blowing wool is typically compressed radially inwardly with respect to the longitudinal axis 100 of the bag 18*b*, the sleeve 96 is effective in restraining the compressed blowing wool 98 in its highly compressed state. As the bag 18*b* is fed through the blowing wool distributing machine 10, the shredder 14 does not have to shred any bag material from the end of the bag 18*b*.

One advantageous feature of the blowing wool machine of the invention is that the chute 12 need not be any larger in cross-section than the approximate cross-section of the bag 18 of blowing wool. This eliminates the need for a large hopper necessary on conventional blowing wool machines to contain the large volume blowing wool that inevitably results when the blowing wool machine operator opens the bag 18 and releases the blowing wool from its compressed state. With the chute 12 being much smaller than the hoppers of typical blowing wool machines, the entire blowing wool machine 10 is much smaller and lighter in weight than conventional machines. Additionally, with the chute 12 being mounted for a rotation to a retracted position as shown at 12*a*, the machine can be made even smaller, i.e., shorter in height, it can be more readily transported and stored. These features allow the machine 10 of the invention to be easily transported in many readily available vehicles, such as family vans and sport utility vehicles, whereas conventional blowing wool machines cannot be transported in such vehicles. The easy availability of transport makes the blowing wool machine 10 of the invention amenable to rental by insulation material outlets, such as the big box home improvement stores.

Another advantage of the invention is that by shredding the bag and distributing the pieces of the bag with the blowing wool into the insulation cavity, the need to dispose of the emptied bags in a landfill or recycling operation, as well as the associated labor for handling the waste material, is eliminated.

Although the ripper 20 is advantageously employed as part of the blowing wool machine 10, it is not a requirement that the machine 10 include the ripper. In a broad sense, the machine for distributing blowing wool from a bag 18 of compressed blowing wool must include a mechanism for disposal of a portion of the bag. While this mechanism can be the ripper 20 described in this specification, it can also be any other mechanism for shredding the trailing edge 68 of the bag or otherwise disposing of a portion of the bag. For example, the mechanism can be a feeder, such as a roller, not shown, for feeding an unshredded portion of the bag to a disposal station, such as a collection bin, not shown. Also, the mechanism for disposal of a portion of the bag can be a laser cutter, not shown, for ripping apart a portion of the bag.

In operation the blowing machine 10 incrementally consumes the bag 18 of blowing wool, typically at a rate of about 10 pounds per minute. This incremental consumption results in a lower, more consistent electrical power demand than that experienced with conventional blowing wool machines, thereby enabling the machine 10 to operate on 110 volt electrical power, which is widely available at building construction sites and existing buildings where the blowing wool is being applied in a retrofit application. Also, the steady, incremental consumption of the bag 18 of blowing wool provides an even flow of material into the rotary valve 16, thereby eliminating clumping of the blowing wool and the resultant plugging of the rotary valve 16 or the distribution hose. The steady flow of blowing wool also enables a reduction in the diameter of the distribution hose.

The principle and mode of operation of this invention have been described in its preferred embodiments. However, it should be noted that this invention may be practiced otherwise than as specifically illustrated and described without departing from its scope.

What is claimed is:

1. A machine for distributing blowing wool from a bag of compressed blowing wool, the machine comprising:

a chute configured to receive the bag and direct the bag in a machine direction;

a shredder mounted at an outlet end of the chute and configured to shred the bag and to pick apart the blowing wool, the shredder including a plurality of blades mounted for rotation on a shaft, the shaft aligned generally perpendicular to the machine direction;

a rotatably mounted ripper, distinct from the shredder, mounted to rip apart a portion of the bag, the ripper including a rotatably mounted roller having a plurality of triangularly-shaped cutting teeth positioned along the length of the roller and a framework intersecting the roller at a first location, the framework having a cutting edge including triangularly-shaped gaps complimentary to the cutting teeth on the roller such that portions of the bag enmesh between the cutting teeth of the roller and the cutting edge of the framework will be ripped apart; and a blower for distributing the blowing wool and shredded bag into an airstream.

2. The machine of claim 1 in which the chute has a cross section which approximates the cross section of the bag.

3. The machine of claim 1 including spacers spacing apart the blades, the spacers having a mechanism which picks apart the wool between the cuts.

4. The machine of claim 3 in which the mechanism for picking apart the wool is plow shaped.

5. The machine of claim 3 wherein the spacer has a mechanism for removing the blowing wool between the cuts.

6. The machine of claim 1 in which the shredder is mounted for rotation, and in which the rotation defines a leading edge and a trailing edge of the bag, and further in which the ripper is mounted to rip apart the trailing edge of the bag.

7. The machine of claim 1 in which the cutting teeth of the roller are spaced apart from other teeth circumferentially about the roller.

8. The machine of claim 1 in which framework includes a second cutting edge intersecting the roller at a different location from the first location.

9. A method of distributing blowing wool from a bag of compressed blowing wool, the method comprising:

providing a bag of compressed blowing wool;

feeding the bag of compressed blowing wool into a chute configured to receive the bag;

shredding the bag with a shredder and picking apart the compressed blowing wool at an outlet end of the chute, wherein the shredder rotates in a clockwise and counter-clockwise motion;

ripping a portion of the bag with a ripper, the ripper including a rotatably mounted roller having a plurality of triangularly-shaped cutting teeth positioned along the length of the roller and a framework intersecting the roller at a first location, the framework having a cutting edge including triangularly-shaped gaps complimentary to the cutting teeth on the roller such that portions of the bag enmesh between the cutting teeth of the roller and the cutting edge of the framework will be ripped apart; and distributing the blowing wool and shredded bag into an airstream.

10. The method of claim 9 in which the shredder is mounted for rotation, and in which the rotation defines a leading edge and a trailing edge of the bag, and in which the ripping step rips apart the trailing edge of the bag.

11. The method of claim 9 in which the blowing wool in the bag of blowing wool is compressed to a compression ratio of at least 5:1.

12. A method of distributing blowing wool from a bag of compressed blowing wool, the method comprising:

providing a bag of compressed blowing wool;

removing an end of the bag;

shredding the remainder of the bag with a shredder and picking apart the compressed blowing wool, the shredder including a plurality of blades mounted for rotation on a shaft, the shaft aligned generally perpendicular to a machine direction;

ripping a portion of the bag with a ripper, the ripper including a rotatably mounted roller having a plurality of triangularly-shaped cutting teeth positioned along the length of the roller and a framework intersecting the roller at a first location, the framework having a cutting edge having triangularly-shaped gaps complimentary to the cutting teeth on the roller such that portions of the bag emnesh between the cutting teeth of the roller and the cutting edge of the framework will be ripped apart; and distributing the blowing wool and shredded bag into an airstream.

13. The method of claim 12 in which the shredder is mounted for rotation, and in which the rotation defines a leading edge and a trailing edge of the bag, and in which the ripping step rips apart the trailing edge of the bag.

14. The method of claim 12 including removing another end of the bag prior to the shredding step.

15. The method of claim 12 in which the removing step comprises tearing away a tear-away portion of the bag.

16. A machine for distributing blowing wool from a bag of compressed blowing wool, the machine comprising:

a chute configured to receive the bag;

a shredder mounted to an outlet end of the chute and configured to shred the bag and pick apart the blowing wool, wherein said shredder rotates in a clockwise and counter-clockwise motion;

a rotatably mounted ripper, distinct from the shredder, mounted to rip apart a portion of the bag, the ripper including a rotatably mounted roller having a plurality of triangularly-shaped cutting teeth positioned along the length of the roller and a framework intersecting the roller at a first location, the framework having a cutting edge including triangularly-shaped gaps complimentary to the cutting teeth on the roller such that portions of the bag enmesh between the cutting teeth of the roller and the cutting edge of the framework will be ripped apart; and a blower for distributing the blowing wool and shredded bag into an airstream;

wherein said chute comprises at least one guide for holding said bag in place as said shredder shreds the bag.

17. The machine of claim 16 in which the chute has a cross section which approximates the cross section of the bag.

18. The machine of claim 16 in which the chute is configured to direct the bag in a machine direction, and in which the shredder includes a plurality of spaced apart blades, mounted for rotation on an axis, with the blades being generally parallel to the machine direction, and with the blades adapted make cuts in the bag of blowing wool.

19. The machine of claim 18 including spacers spacing apart the blades, the spacers having a mechanism which picks apart the wool between the cuts.

20. The machine of claim 19 in which the mechanism for picking apart the wool is plow shaped.

21. The machine of claim 19 wherein the spacer has a mechanism for removing the blowing wool between the cuts.

22. The machine of claim 15 in which the shredder is mounted for rotation, and in which the rotation defines a leading edge and a trailing edge of the bag, and further in which the ripper is mounted to rip apart the trailing edge of the bag.

* * * * *